US008899379B2

(12) United States Patent
Lombardi

(10) Patent No.: US 8,899,379 B2
(45) Date of Patent: Dec. 2, 2014

(54) MASON'S ADJUSTABLE CHIMNEY-PLATFORM ARRANGEMENT

(76) Inventor: Donald F. Lombardi, Manchester, MA (US)

( * ) Notice: Subject to any disclaimer, the term of this patent is extended or adjusted under 35 U.S.C. 154(b) by 879 days.

(21) Appl. No.: 12/658,868

(22) Filed: Feb. 16, 2010

(65) Prior Publication Data

US 2010/0276228 A1 Nov. 4, 2010

Related U.S. Application Data

(60) Continuation-in-part of application No. 12/287,787, filed on Oct. 14, 2008, now Pat. No. 7,661,372, which is a division of application No. 11/499,374, filed on Aug. 5, 2006, now Pat. No. 7,434,521.

(51) Int. Cl.

| | |
|---|---|
| ***E04G 1/00*** | (2006.01) |
| ***B66F 11/04*** | (2006.01) |
| ***E04G 1/22*** | (2006.01) |

(52) U.S. Cl.

CPC ..... *B66F 11/046* (2013.01); *E04G 1/22* (2013.01)

USPC ..... 182/2.1

(58) Field of Classification Search

USPC ..... 182/182, 2.1, 222, 63.1, 148

See application file for complete search history.

(56) References Cited

U.S. PATENT DOCUMENTS

| | | | | |
|---|---|---|---|---|
| 3,095,945 | A * | 7/1963 | Mitchell | 182/14 |
| 3,509,965 | A * | 5/1970 | Mitchell | 182/62.5 |
| 3,590,948 | A * | 7/1971 | Milner, Jr. | 182/2.1 |
| 5,205,603 | A * | 4/1993 | Burdette, Jr. | 296/62 |
| 5,337,854 | A * | 8/1994 | Brandt | 182/2.9 |
| 6,834,903 | B2 * | 12/2004 | Harper et al. | 296/51 |
| 6,913,305 | B1 * | 7/2005 | Kern et al. | 296/51 |
| 7,370,725 | B1 * | 5/2008 | Dornfeld | 182/2.2 |
| 7,549,692 | B2 * | 6/2009 | Washington | 296/61 |
| 7,661,372 | B2 * | 2/2010 | Lombardi | 108/54.1 |
| 8,151,935 | B2 * | 4/2012 | Graham | 182/69.5 |
| 2003/0198550 | A1 * | 10/2003 | Granroth et al. | 414/685 |
| 2005/0173192 | A1 * | 8/2005 | Waisanen et al. | 182/141 |
| 2008/0135334 | A1 * | 6/2008 | Graham | 182/141 |
| 2009/0108614 | A1 * | 4/2009 | Washington | 296/61 |
| 2009/0236180 | A1 * | 9/2009 | Grandy | 182/128 |
| 2009/0297314 | A1 * | 12/2009 | Jaeger et al. | 414/563 |
| 2012/0018253 | A1 * | 1/2012 | Taberah | 182/141 |

* cited by examiner

*Primary Examiner* — Katherine Mitchell
*Assistant Examiner* — Candace L Bradford
(74) *Attorney, Agent, or Firm* — Don Halgren

(57) ABSTRACT

An adjustable platform assembly for supporting workers and supplies about an elevated work site, the platform assembly being movably supported on an articulable support, the platform comprising a stationary rear bridging panel arrangement having an elongated side platform member comprising a floor and railing assembly at each end thereof, wherein each elongated side platform member floor and railing assembly is independently movable on support members forwardly, rearwardly, transversely and angularly with respect to the bridging panel arrangement, to change the platform assembly back and forth between a generally "H" shape to a generally "U" shape, or any skewed combination thereof, as required.

11 Claims, 17 Drawing Sheets

MASON'S ADJUSTABLE CHIMNEY-PLATFORM ARRANGEMENT

This application is a Continuation-In-Part application of U.S. patent application Ser. No. 12/287,787, Oct. 14, 2008 now U.S. Pat. No. 7,661,372, which is a divisional application of U.S. patent application Ser. No. 11/499,374 Aug. 5, 2006 now U.S. Pat. No. 7,434,521, each of which is incorporated herein by reference in its entirety.

BACKGROUND OF THE INVENTION

1. Field of the Invention

This invention relates to lift platforms to facilitate chimney construction, and more particularly to articulable lift platforms attachable to mechanical arm arrangements to be utilized for construction at above the ground locations.

2. Prior Art

The construction industry, particularly that which is involved in the home and building field have a difficult time reaching elevated structures, such as chimneys on roofs or the like, to rebuild them or to get around them. Often those structures are several stories high off of the ground. Movement and work space around them is too often very limited.

Those in the masonry business may readily attest to this. Getting bricks, mortar and personnel to an elevation several stories above the ground, and keeping them there in a safe and stable manner where they can productively work is something much to be desired.

It is a further object of the present invention to provide an articulable platform which is adapted to the attached to the distal end of an articulable arm, for safe hoisting and lowering of personnel and equipment to a roof of a building.

It is a further object of the present invention, to provide an articulable platform which may be adapted to the particular construction irregularities of a particular work site.

It is still yet another object of the present invention, to provide a work space or platform which is maneuverable, safe and has the ability to be changed and controlled in its elevated most position.

It is a further object of the present invention to provide an adaptable platform arrangement which may have side platform portions which may be pivoted about a rotary foundation on their support bases to be permitted to surround, apply transverse pressure or provide spaced-apart or close accommodation to a vertical or non-rectilinear structure more readily.

BRIEF SUMMARY OF THE INVENTION

The present invention comprises an articulable platform which is securable to the distal end of an articulable arm. The articulable arm is typically telescopingly arranged on the distal end of a movable arm supported on a lift truck. The lift truck provides a mobile base from which the articulable platform may be moved and adjusted.

The articulable arm has a distalmost end with a securement member thereon. The platform has a lower anchor plate and a lower support frame to which the securement member is attached, by a bolt and slider mechanism. A rear wall plate is attached to the lower anchor plate and the lower support frame. A right sidewall frame and a left sidewall frame are attached to the respective side edges of the rear wall frame.

The respective sidewall frames each have an upper elongated channel and a lower elongated channel. The sidewall frames each slidably support a slidable side wall. An upper right rail of a right slidable side wall slides through the upper elongated channel of the right sidewall frame. A lower rail of the right slidable side wall slides through the lower elongated frame of the right sidewall frame. The right slidable side wall has a transverse bar at its distalmost end and it has a transverse bar. The right slidable sidewall has a right-side proximal transverse bar at the rear end of the right slidable sidewall. The right-side proximal transverse bar butts into a right sidewall frame transverse bar when the right slidable sidewall is extended distally its maximum amount.

The left sidewall frame has a left slidable sidewall arranged in a similar manner to the aforementioned right sidewall frame. An upper left rail of a left slidable sidewall slides through the upper elongated channel of the left sidewall frame. A lower rail of the left slidable side wall slides through the lower elongated frame of the left sidewall frame. The left slidable sidewall has a transverse bar at its distalmost end and it has a transverse bar. The left slidable sidewall has a left-side proximal transverse bar at the rear end of the left slidable sidewall. The left-side proximal transverse bar butts into a left sidewall frame transverse bar when the left slidable sidewall is extended distally its maximum amount.

The right sidewall frame and the left sidewall frame may in one embodiment, each have a fold down floor panel member arrangement with a hinge arranged along a lower portion thereof. Each left and right slideable sidewall has a lower bar which moves along with their respective left and right slidable sidewalls, the lower bar of each being hingedly attached to an elongated side plate which may be pivoted into supported engagement with a portion of the rear floor on each side of the lower anchor plate.

In operation of the articulable platform on the distal end of the articulable arm on the lift truck, that articulable platform may engageably receive between its elongated side floors, any chimney or vertical structure therebetween. Those slidable sidewalls may be moved forwardly and rearwardly, that is away from and back towards the rear wall frame. Such sidewall movement effects a change in the "plan" view of the platform, that is, from an "H" shape to a "U" shape with variable side positions or a variable "bridging' portion length. For instance, if the platform were utilized above a chimney on a slanted roof, the slidable sidewalls would only be independently extended from their respective right sidewall frame and left sidewall frame enough to clear the sides of the chimney without damaging any inclined roof there adjacent. To fully surround a chimney or structure, those independently slidable sidewalls would be extended away from the rear wall frame so as to provide the elongated side floors their full extendibility thereadjacent. The distal end of those side floors may also be rested upon the sloping side of the roof through which the chimney extends.

It is further contemplated that a front floor plate with a front wall may be adjustably and removably disposed between the distalmost end of the respective elongated side floors with a corner attachment coupler secured at each end of the front floor plate wall to the ends of the respective left and right slidable sidewalls. The front wall and front floor plate may be hingedly attached to one another by an elongated hinge along their lower portion thereof.

Insert panels may be disposed between the chimney and the elongated edges of the elongated side floors and the edges of the rear floor and the front floor for in close support of personnel and material on the platform.

The invention thus comprises a generally "U" to "H" (or vice versa) shaped distibutively adjustable articulable platform, attachable to the distal end of an articulable support arm of a transport vehicle. Such support arm may include an elongated crane or derrick which is supportive of and connected to the articulatable platform by a plurality of cables. The platform is arranged to adjustably surround an elevated chimney on at least three sides thereof. The platform may be comprised of: a rectilinear lower anchor plate centrally disposed within an elongated lower support frame, a rectilinear rear anchor plate connected perpendicularly to the lower anchor plate, the rectilinear rear anchor plates centrally and connectively disposed within an elongated rectilinear rear wall frame, all comprising a "bridging" portion, a right sidewall frame and a left sidewall frame connected to respective end portions of the elongated rear wall frame, connected to respective end portions of the lower support frame; and a right slidable sidewall slidably disposed within the right sidewall frame, and a left slidable sidewall slidably disposed within the left sidewall frame, to provide adjustable portions thereof around an elevated structure (chimney) for supporting personnel and equipment therefor. The left slidable sidewall and the right slidable sidewall may each have an elongated lower portion with a hinge thereon, each of the hinges being attached to an elongated side floor, each of the side floors being in pivotable engagement with and slidable support with respect to the lower support plate of the platform for support thereof. Each of the slidable sidewalls are preferably movable independently of one another. An elongated front floor may be nestably disposable between the elongated side floors when the side floors are disposed in a horizontal orientation. The front floor is preferably hingedly attached to a front wall to provide full peripheral enclosure by a succession of wall members on the platform in an elevated orientation, while surrounding a chimney. The platform may include a plurality of plate inserts, the plate inserts being supported upon edge portions of the hingedly attached side floors and the hingedly attached front floor. The right and left sidewall frames preferably have elongated channels, and the slidable sidewalls have elongated structure members which are arranged to telescopingly slide through the channels for support of the side walls in the side wall frame.

The invention also comprise a method of supporting a work crew on an elevated chimney work site, comprising one or more of the following steps of: attaching a generally "U" to "H" or "H" to "U" shaped (in a plan view) articulable platform assembly to the distal end of an articulable support arm of a transport vehicle, wherein the platform is arranged to adjustably surround an elevated chimney on at least three sides thereof, wherein the platform is comprised of a rectilinear lower anchor plate centrally disposed within an elongated lower support frame, a rectilinear rear anchor plate connected perpendicularly to the lower anchor plate for attachment to an articulable arm on a mobile transport, the rectilinear rear anchor plates centrally and connectively disposed within an elongated rectilinear rear wall frame, a right sidewall frame and a left sidewall frame connected to respective end portions of the elongated rear wall frame, and connected to respective end portions of the lower support frame, a right slidable sidewall telescopingly slidably disposed within the right sidewall frame, and a left slidable sidewall telescopingly slidably disposed within the left sidewall frame, to provide adjustable portions thereof around an elevated (chimney) structure for supporting personnel and equipment therefor; moving the right sidewall and the left sidewall independently with respect to one another to adjust the distribution of the sides of the platform relative to a chimney. The method may include the step of: placing a shoulder edge of a further rectilinear support frame adjacent to and supportively on an edge of at least two adjacent rectilinear support panel plates on the platform assembly.

The invention also comprises an adjustable platform for supporting workers and supplies about an elevated work site, said platform movably supportable on an articulable support arm. The platform comprises an elongated rectilinear bridging panel arrangement and an elongated floor and railing assembly at each end thereof, wherein each elongated floor and railing assembly are independently movable on support members forwardly and rearwardly with respect to the bridging panel arrangement to change the platform from an "H: shape to a "U" shape or with any combination of one side platform extending fully or partially forward or rearward with the other side platform extending either fully forward or partially forward or rearward, as required. The bridging panel member portion may be elongatedly adjustable to change the width of the platform relative to a work project dimension.

The invention thus also comprises an articulable, elevated-structure-engaging platform assembly, adjustable between an "H" shape, a "U" shape or combination thereof, the platform assembly being attachable to an overhead support, the platform assembly being arranged to adjustably surround an elevated structure on at least three sides thereof, the platform assembly comprising: a stationary anchor plate support frame bridging member comprising a rear floor; a right side platform and a left side platform slidably and pivotably connected to the anchor plate support frame bridging member rear floor, to provide adjustable "side" portions to the platform assembly, the side portions each being movable in a direction away from and returnable in a direction towards the rear floor, and to be pivotable towards and away from one another, so as to be articulable around at least one side of an elevated structure for lifting, supporting and even closely squeezing the structure, with personnel and equipment thereat. The right and left side platforms are preferably pivotable and movable independently with respect to the left and right sides platforms respectively. The right side platform and/or the left side platform may be of curved configuration for some or all of its/their length. The overhead support structure preferably may comprise at least one crane or derrick. The at least one crane or derrick preferably has a plurality of cables connected to the platform assembly to maintain stability of that platform assembly. The cables are preferably connected to both ends of the side platforms. At least one side platform is attached to the bridging member by a rotary support means therebetween, to permit the pivoting movement of the side platform with respect to the bridging member. The rotary support unit may comprise a properly controlled worm gear arrangement.

The invention also may comprise a method of supporting a work crew on an elevated structure, comprising one or more of the following steps of: attaching a generally "H" to "U" shaped articulable platform assembly to an overhead support such as an arm arrangement or overhead crane arrangement, wherein the platform assembly may be arranged to adjustably surround an elevated structure on at least three sides thereof; moving at least one side platform member with respect to a stationary rear bridging member of the platform assembly so as to re-shape the platform assembly, thereby forming at least a partial structure-surrounding work-crew platform assembly; moving the right side platform member and the left side platform member independently of one another, wherein the left side platform and the right side platform are individually movable longitudinally, transversely and pivotably with respect to one another, and wherein the platform assembly may be supported from the overhead support by a lift arm or a plurality of cables.

The invention also comprises an adjustable platform assembly for supporting workers and supplies about an elevated work site, the platform assembly being movably supported on an articulable support, the platform comprising a stationary rear bridging panel arrangement having an elongated side platform member floor and railing assembly at each end thereof, wherein each elongated side platform member floor and railing assembly is preferably independently movable on support members forwardly, rearwardly, transversely and angularly with respect to the bridging panel arrangement to change the platform assembly back and forth between a generally "H" shape to a generally "U" shape, or any skewed combination thereof, as required.

BRIEF DESCRIPTION OF THE DRAWINGS

The objects and advantages of the present invention will become more apparent, when viewed in conjunction with the following drawings in which:

FIG. 11 is a plan view of the side platforms and the rear platform with its further embodiment of transverse and/or pivotable adjustability thereof being supportable from an overhead arrangement of cranes or the like.

DETAILED DESCRIPTION OF THE PREFERRED EMBODIMENT

Figure 1:
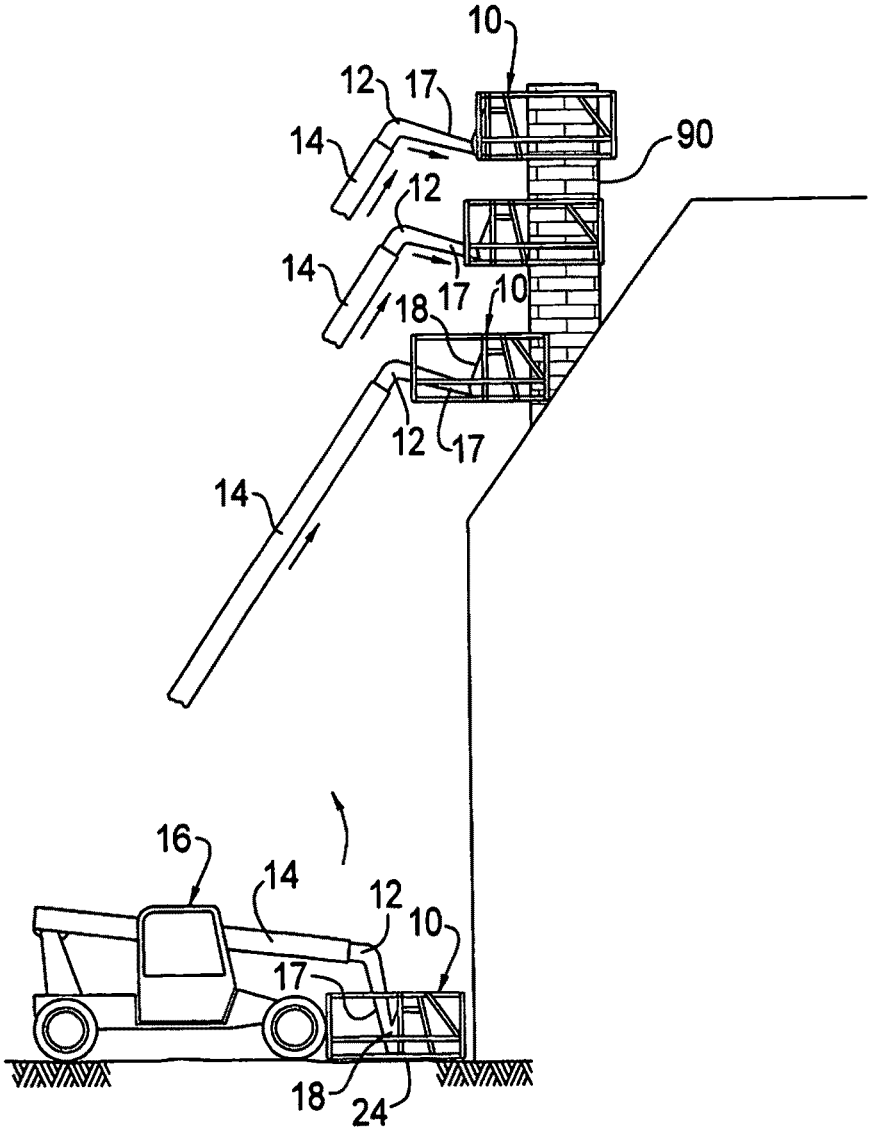
FIG. 1 is a side elevational view of a lift truck and arm arrangement adapted to move an articulated platform, in a side elevational view shown in several positions of the platform against a building structure.

Referring now to the drawings in detail, and particularly to FIG. 1, there is shown the present invention which comprises an articulable platform 10 that is securable to the distal end of an articulable arm 12. The articulable arm 12 is typically telescopingly arranged on the distal end of a movable arm 14 supported on a lift truck 16. The lift truck 16 provides a mobile base from which the inventive articulable platform 10 may be moved and adjusted around an elevated chimney 90, or the like, to provide a mason's platform during work on that chimney 90.

The articulable arm 12 has a distalmost end 17 with a generally "L" shaped (in cross-section) platform securement member 18 thereon. The articulable platform 10 has a preferably rectangularly-shaped lower anchor plate 20 and an elongated rectangular, lower peripheral support frame 22 to which the lower extremity of the "L" shaped platform securement member 18 is attached at several points, by a bolted anchor mechanism 24, as partially represented in FIG. 1. A rear anchor plate 26 is ridgidly and fixedly attached, as for example by welding, in a perpendicular manner to the bottom side of the lower anchor plate 20 and the lower support frame 22. The securement member 18 also preferably being secured to the rear anchor plate by another bolted anchor mechanism 24, secured through bolt holes 25, as best represented in FIG. 2.

Figure 2:
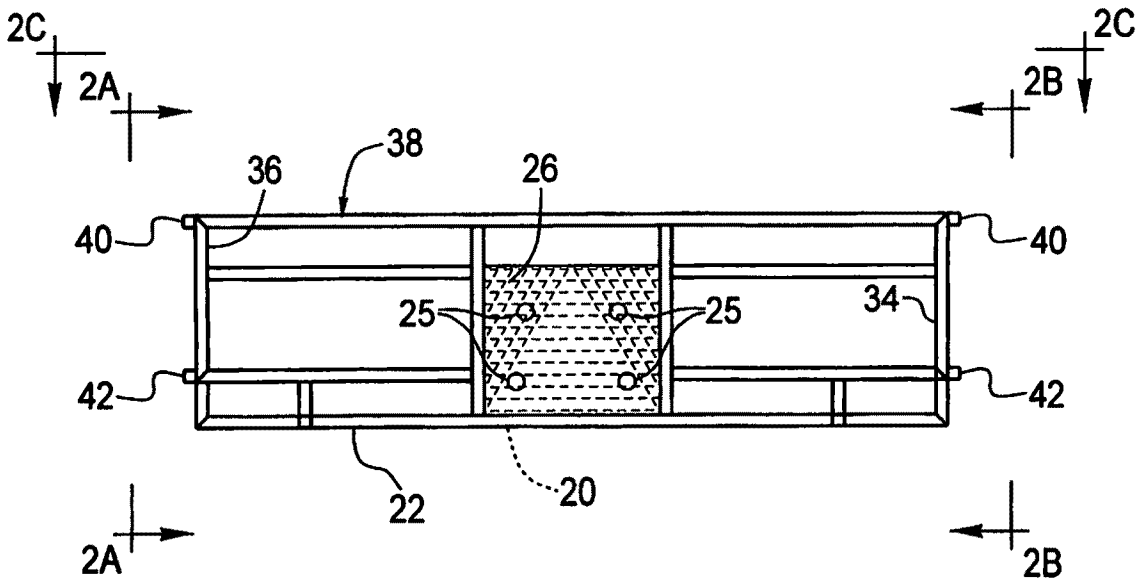
FIG. 2 is a side elevational view of the rear wall of the platform.
Figure 2A:
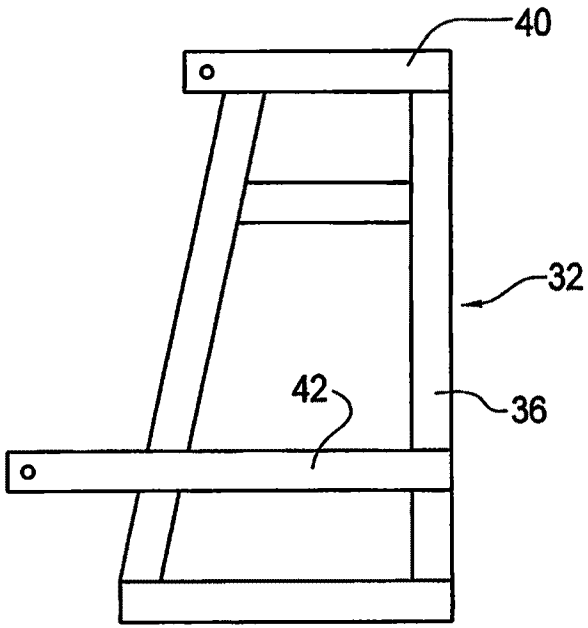
FIG. 2A is a view taken along the lines 2A-2A of FIG. 2.
Figure 2B:
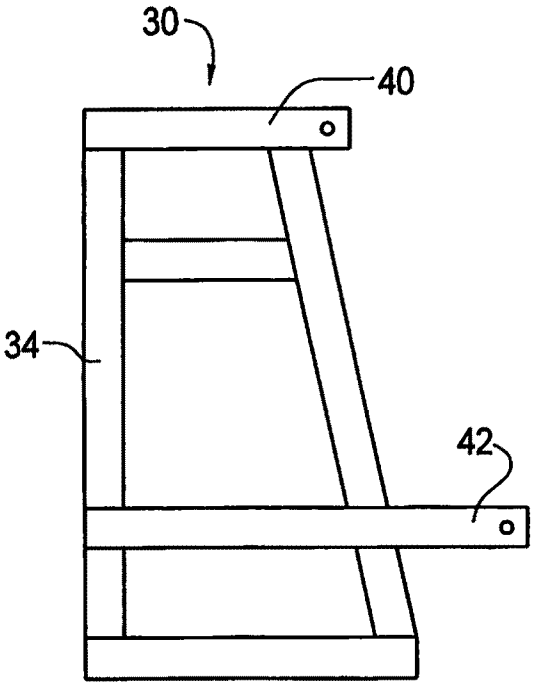
FIG. 2B is a view taken along the lines 2B-2B of FIG. 2.
Figure 2C:
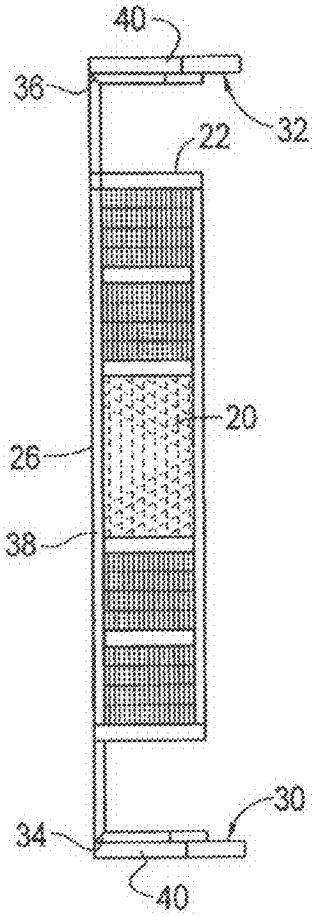
FIG. 2C is a view taken along the lines 2C-2C of FIG. 2.

A right sidewall frame 30, best represented in FIG. 2B and a left sidewall frame 32, best represented in FIG. 2A, are each attached, as for example, by welding, to and define the respective right and left side frame members 34 and 36 of the rear wall frame 38, as represented in FIG. 2. The respective sidewall frames 30 and 32 each have an upper elongated channel 40 and a lower elongated channel 42 parallel to one another, as shown in FIGS. 2A and 2B. The length of upper elongated channel 40 is approximately one half of the length of its adjacent lower elongated channel 42, to provide stronger support to floor panels telescopingly supported thereby, near the lower channel 42 on the platform 10.

Figure 3:
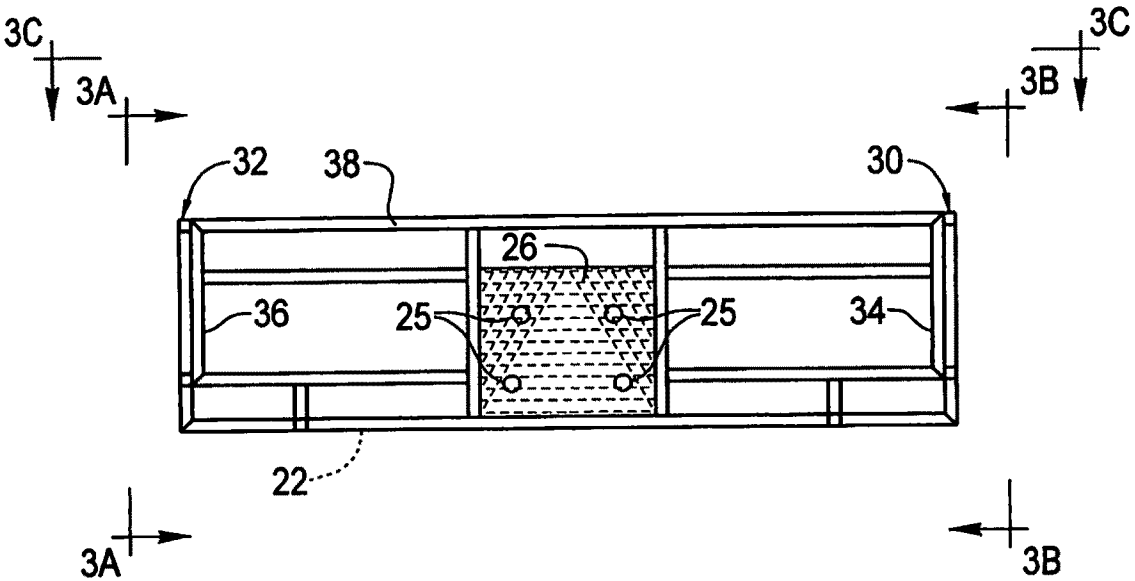
FIG. 3 is an elevational view of the rear wall of the platform, with portions of the floor and sidewalls thereattached.
Figure 3A:
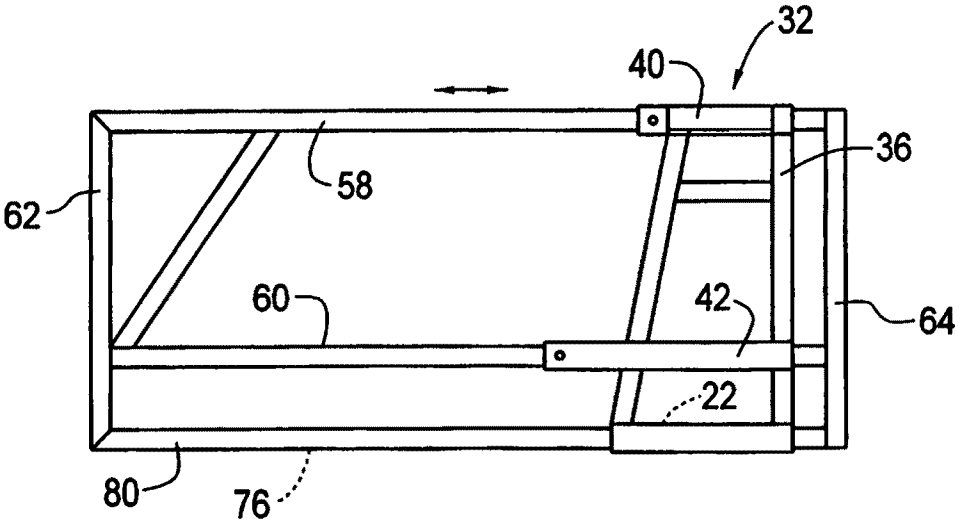
FIG. 3A is a view taken along the lines 3A-3A of FIG. 3.
Figure 3B:
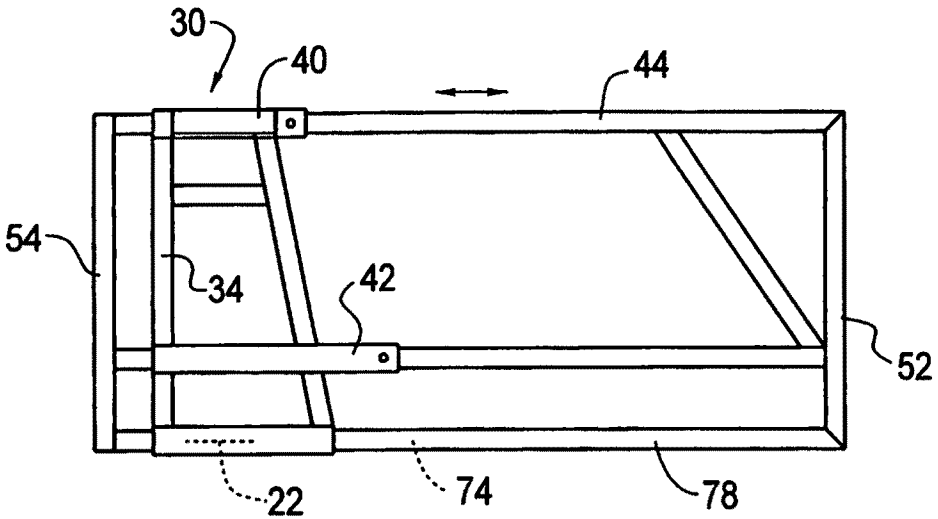
FIG. 3B is a view taken along the lines 3B-3B of FIG. 3.

The sidewall frames 30 and 32, connected to the ear wall frame 38, each slidably support a slidable side wall 44 and 46 respectively, as represented in FIGS. 3A and 3B. An upper right rail 48 of the right slidable sidewall 44, shown in FIG. 3B, telescopingly slides through the supportive upper elongated tubular channel 40 of the right sidewall frame 30. A lower rail 50 of the right slidable side wall 44 telescopingly slides through the supportive lower elongated tubular channel 42 of the right sidewall frame 30, as shown in FIG. 3B. The right slidable sidewall 44 has a transverse bar 52 at its distalmost end. The right slidable sidewall 44 has a right-side proximal transverse bar 54 at the rear or proximal end of the right slidable sidewall 44, as represented in FIG. 3B. The right-side proximal transverse bar 54 closely butts into a right sidewall frame 38 transverse bar edge 34 when the right slidable sidewall 44 is extended distally its maximum amount.

The left sidewall frame 32 has a left slidable sidewall 46 arranged in a similar manner to the aforementioned right sidewall frame 30. An upper left rail 58 of the left slidable sidewall 46 slides telescopingly through the supportive upper elongated tubular channel 40 of the left sidewall frame 32 as represented in FIG. 3A. A lower rail 60 of the left slidable sidewall 46 slides through the supportive lower elongated channel 42 of the left sidewall frame 32. The left slidable sidewall 46 has a transverse bar 62 at its distalmost end and it has a transverse bar 64 at its proximal end. The left-side proximal transverse bar 64 closely butts into a left sidewall frame 38 transverse bar edge 37 when the left slidable sidewall 46 is extended distally its maximum amount, as represented in FIG. 3A and the uppermost representation of the assembly shown FIG. 4.

Figure 3C:
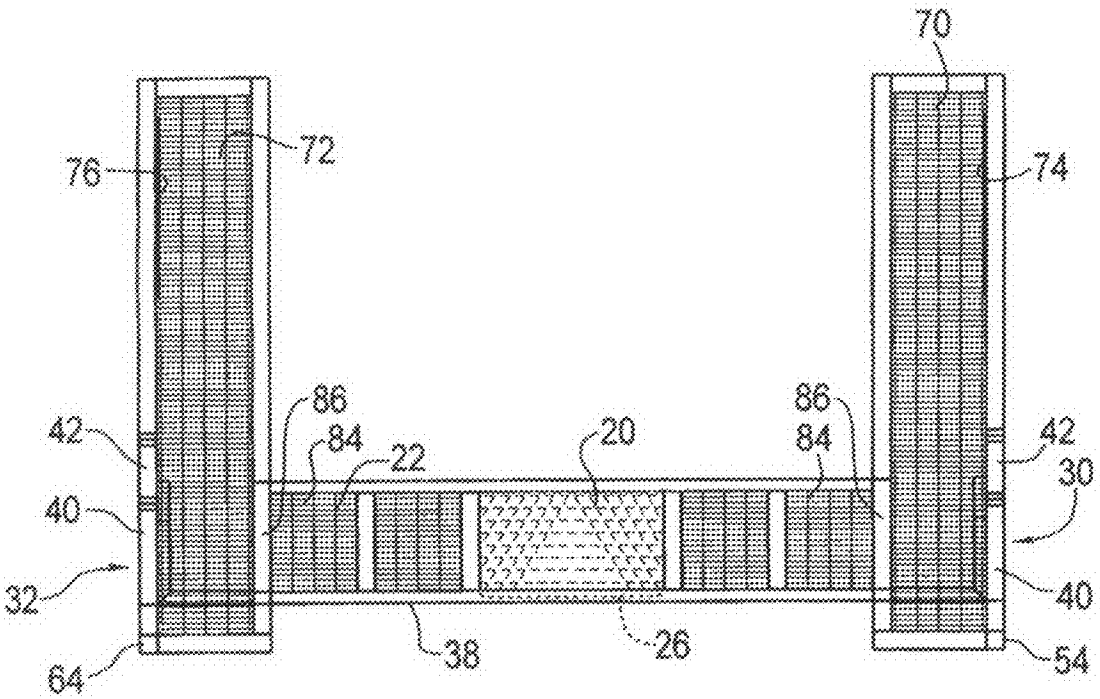
FIG. 3C is a view taken along the lines 3C-3C of FIG. 3.

The right slidable sidewall 44 and the left slidable sidewall 46 each have an elongated fold-down support plate or panel member 70 and 72 respectively, as represented in FIG. 3C. Each sidewall 44 and 46 is connected to their respective support panel or plate 70 and 72 by an elongated distally disposed hinge 74 and 76 connectively arranged along respective lower bar portions 78 and 80 thereof between the plate members 70 and 72. The support plates 70 and 72 are supported on their "hinge-opposite" sides by a lip thereof using ridably sliding support on the lower support frame 22. Each left and right slideable sidewall 46 and 44 has their lower bars 78 and 80, respectively, movable along with their respective left and right slidable sidewalls 44 and 46, the lower bar 78 and 80 of each being hingedly attached to the elongated side plates 70 and 72 which may also be pivoted into supported engagement with a portion of the rear floor 84 on each side of the lower anchor plate 20, which is part of the lower support frame 22. The outer edge of each rear floor 84 has a support edge 86 on which the elongated hingedly pivotable side support plate members 70 and 72 may themselves supportively slide/rest.

Figure 4:
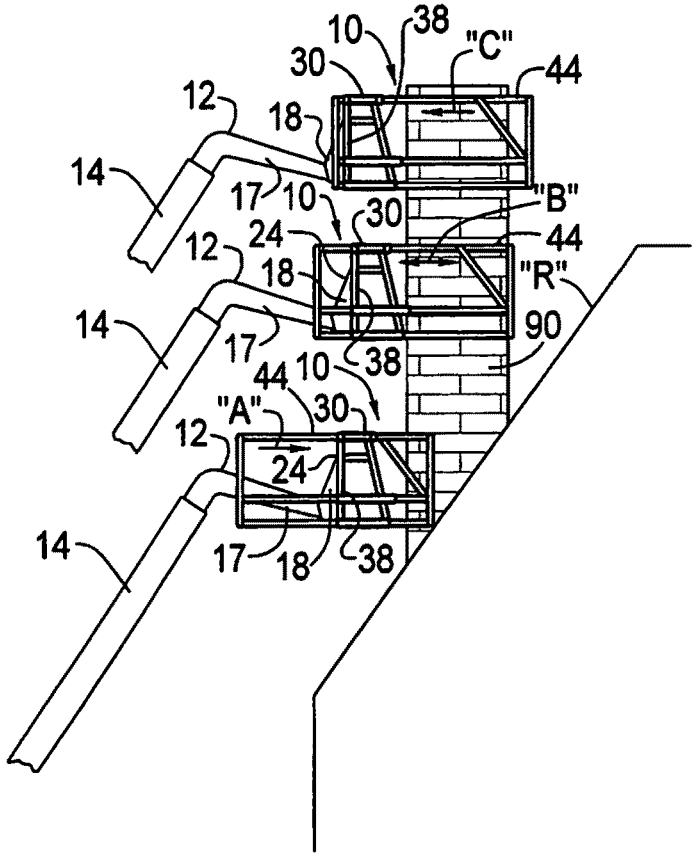
FIG. 4 is a side view of the articulable platform and its associated lift arm at different locations about a structure.
Figure 5:
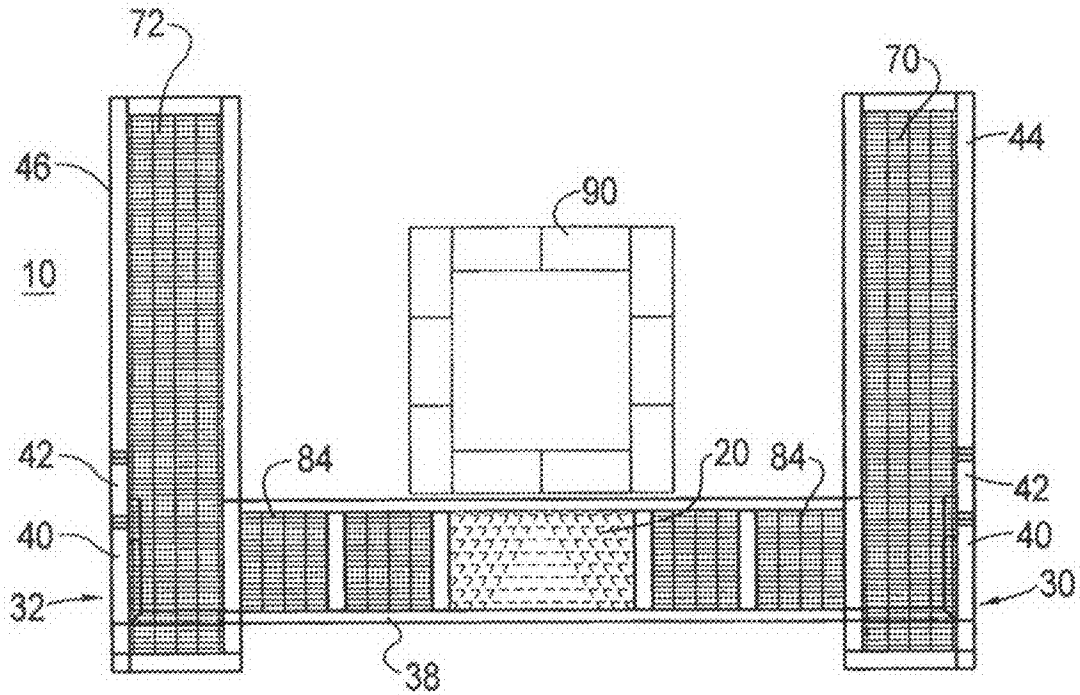
FIG. 5 is a plan view of the platform fully extended.

In operation of the articulable platform 10 on the distal end 17 of the articulable arm 12 on the lift truck 16, that articulable platform 10 may engageably receive between its elongated side floors 70 and 72, with a chimney or vertical structure 90 therebetween, as represented by side views in progressive stages of extended engagement of the arm 12, and concomitant extension of the sidewalls walls 44 and 46, and the platforms 70 and 72, as represented in FIG. 4, and in a plan view in FIG. 5, going from an "H" shape to a "U" shape in plan view. Those slidable sidewalls 44 and 46 may be moved forwardly and rearwardly, that is away from and back towards the rear wall frame 38, as represented by arrows A, B and C shown in the different positions of the sidewalls 44 and 46 in FIG. 4. For instance, if the platform 10 were utilized above a chimney 90 on a slanted roof "R", the slidable sidewalls 44 and 46 would only be independently extended from their respective right sidewall frame 44 and left sidewall frame 46 enough to clear the sides of the chimney without damaging any inclined roof "R" thereadjacent, but the distal ends may rest upon such roof "R" as necessary.

Figure 6:
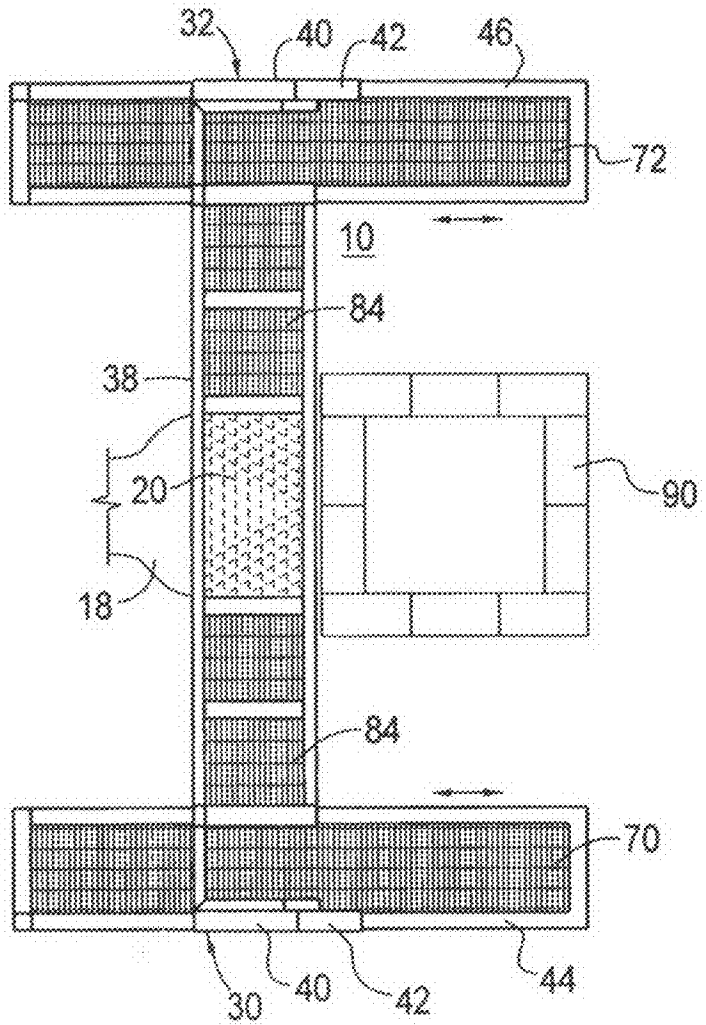
FIG. 6 is a plan view of the platform partially extended.

To fully surround a chimney or structure 90, as represented in a plan view in FIG. 5, those independently slidable sidewalls 44 and 46 and their respective hingedly associated support plates 70 and 72 would be extended away from the rear wall frame 38 so as to provide the elongated side floors their full extendibility thereadjacent, as shown in FIG. 5. FIG. 6 represents a plan view of the platform 10 in a partially extended mode, relative to the chimney 90, and shows the platform's configuration in the "H" shape.

Figure 7:
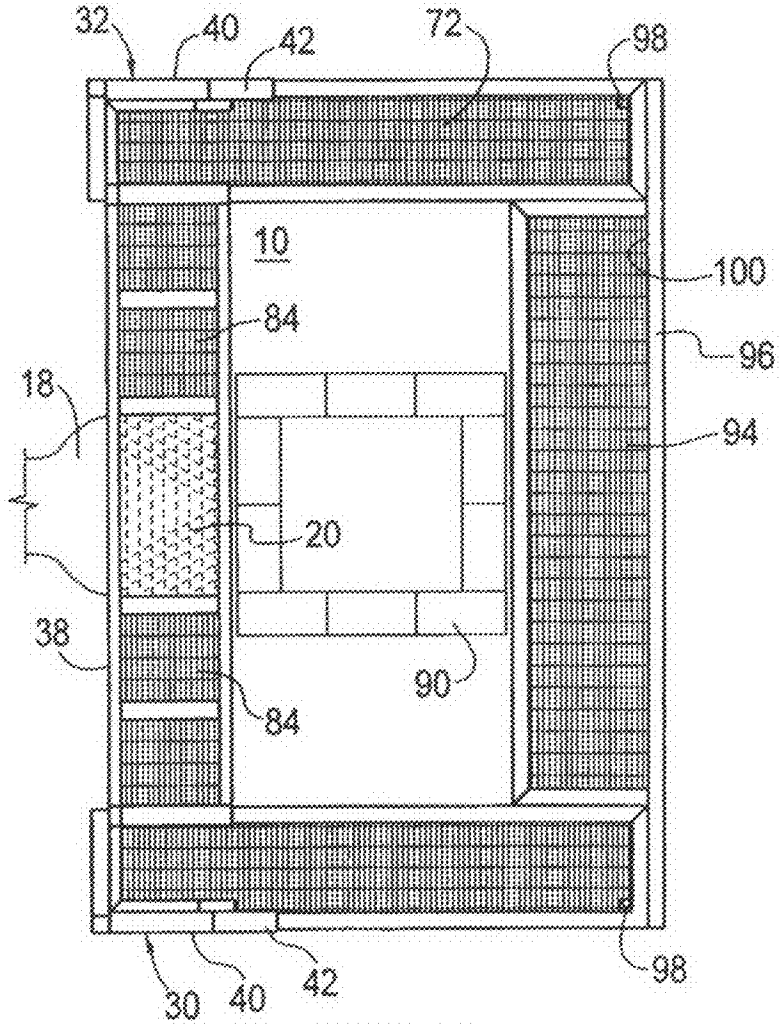
FIG. 7 is a plan view of the platform with a front floor thereattached.

It is further contemplated that an elongated, rectilinearly shaped front floor plate 94 with a hingedly attached front wall 96 may be adjustably and removably disposed between the respective distalmost ends of the respective properly reinforced supportive elongated side plates 70 and 72, as represented in FIG. 7. The front floor plate 94 preferably includes a proper corner attachment coupler 98 secured at each end of the front of the floor plate wall 96 to the ends of the respective left and right slidable sidewalls 44 and 46. The front wall 96 and front floor plate 94 may be hingedly attached to one another by an elongated hinge 100 or weldably attached along their connective adjacent portions thereof.

Figure 8:
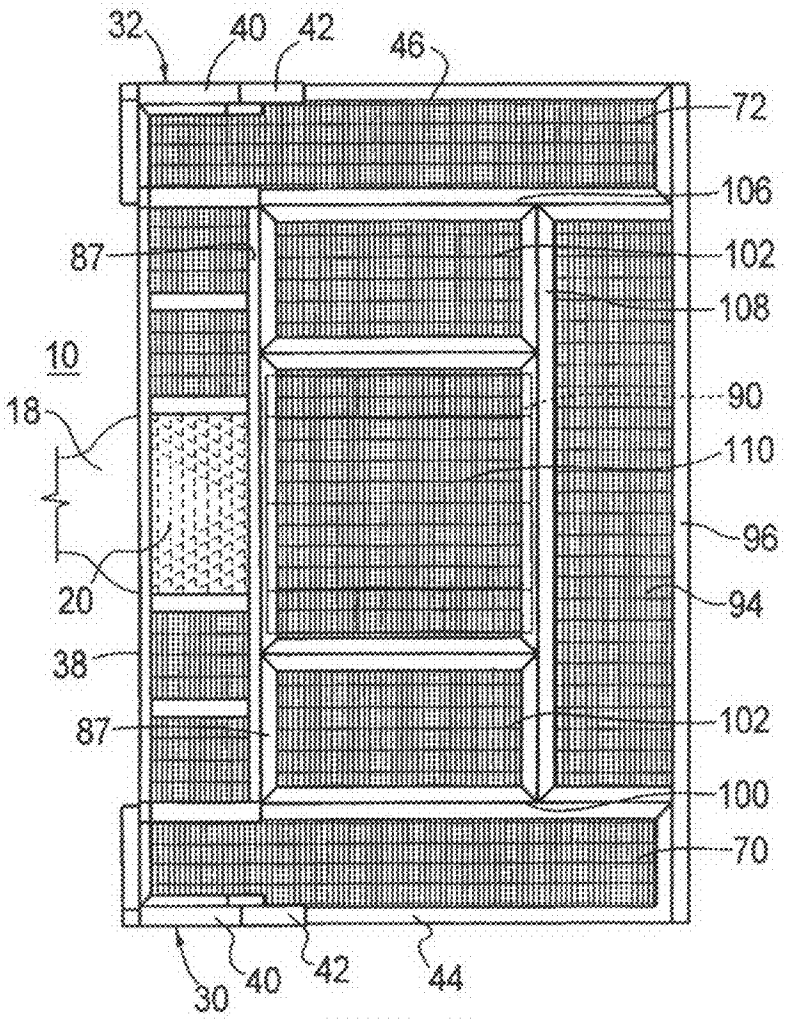
FIG. 8 is a plan view of a platform with a number of floor inserts shown arranged therein.
Figure 9:
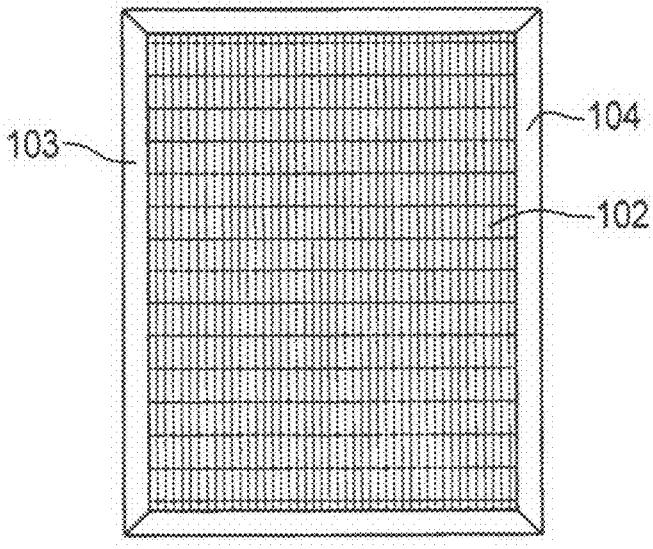
FIG. 9 is a plan view of an insert utilized in the floor plan of the present articulated platform.

An arrangement of rectilinear Inserts 102 may be disposed between the chimney 90 and the elongated edges of the elongated side floors 70 and 72, and the edges 87 of the rear floor 84 and the front floor 94 for in-close support of personnel and material on the platform 10, as is represented in FIG. 8. Such an insert 102 is represented in FIG. 9, in a plan view thereof. The insert 102 comprises a lipped rectilinear frame 104 having edge shoulder portions which properly rest upon the adjacent edges 106 and 108 of the floors 70 and 72 and the front plate 94, respectively, as represented in FIG. 8. Also shown in FIG. 8 is a central support plate 110, above the chimney 90, which is shown in dashed format. Such a central plate 110 has peripheral shoulder edges for proper restive support on adjacent peripheral plates 102, 94 and 84, when needed. Angle iron members, not shown for clarity of views, may be arranged between the side floors 70 and 72 for as needed peripheral support of various panel members, where such support is proper.

Figure 10:
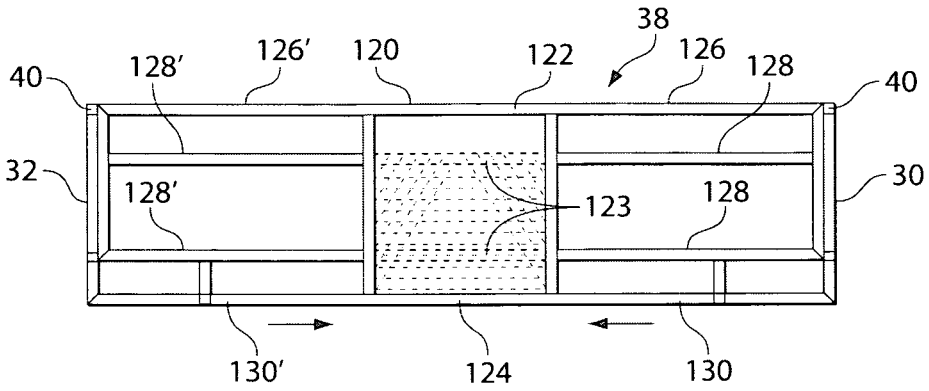
FIG. 10 is an elevational view of the rear wall showing a further embodiment of transverse telescoping adjustability thereof.
Figure 11:
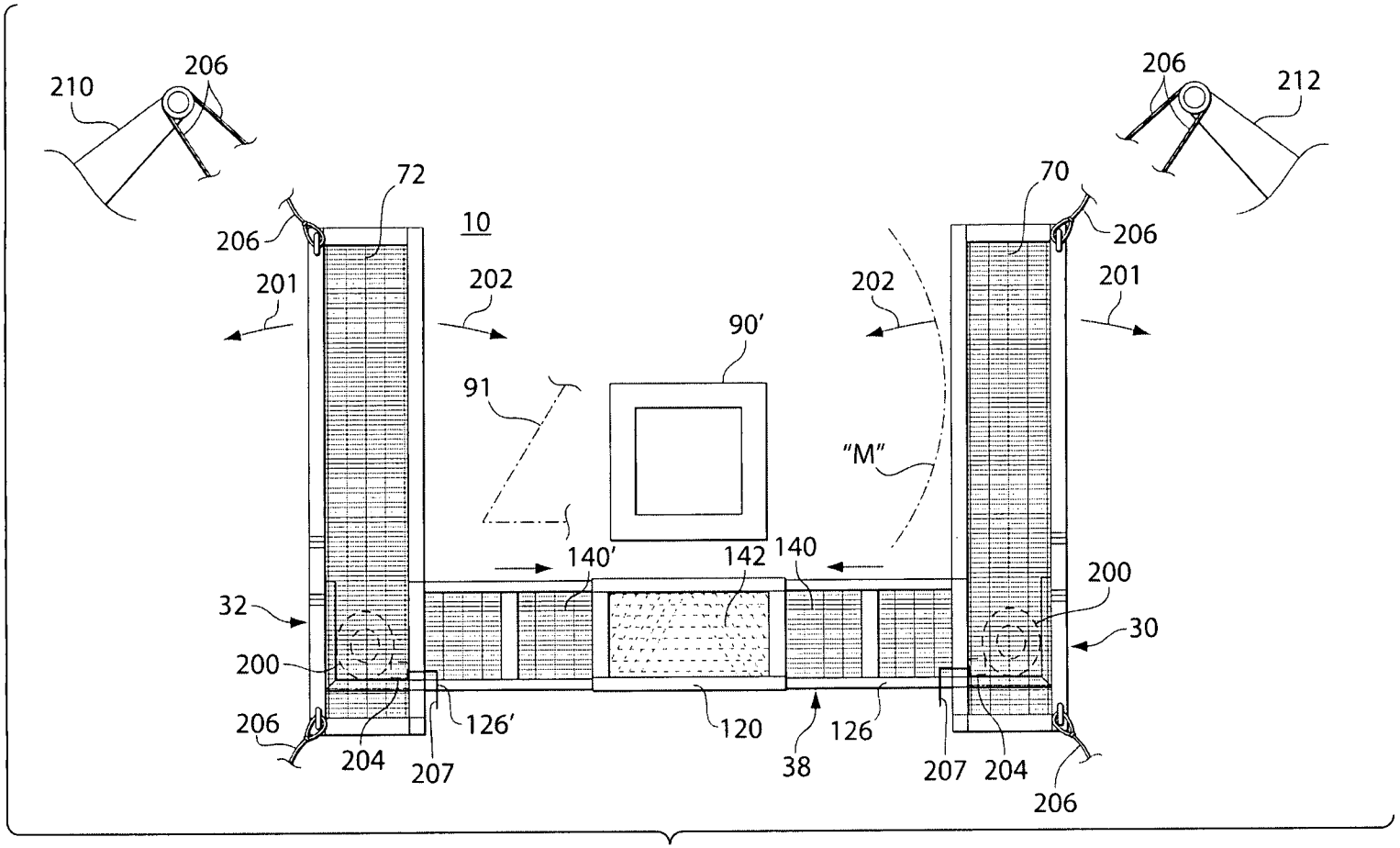

A further preferred embodiment of the present invention is shown in FIG. 10, wherein the rear wall frame 38 is divided into a unitary mid-portion 120 having upper, intermediate and lower rail members 122, 123 and 124, through which right end and left end wall portions rail members 126, 128 and 130, and 126', 128' and 130' of rear wall frame 38 respectively slide supported therethrough, telescopingly or otherwise surely supported in a proper manner thereby. Such an adjustable slidability to the right and left end wall portions 126 and 126' is also represented in FIG. 11, showing transversely shiftable deck panels 140 and 140' which are adjustably slidable under the "bridging" portion mid-portion deck panel 142. This side-independent limited transverse movability is important to provide floor panels with support to workers working on a narrow chimney or small project 90' requiring close work/material support. Note that such a mid-portion deck panel 142 may have an underside bridging member which is attachable to the generally "L" shaped platform securement member 18, to facilitate proper movement of such side floors without interference of the lift arm and its member 18. FIG. 11 shows the platform 10 in a plan view somewhat rebetween thepresenting the "U" shape.

FIG. 11 also shows a rotary support unit means 200 arranged between each of the shiftable side deck panels 140 and 140' and their respective side platform members 30 and 32 for further articulation thereof. The side platforms 30 and 32 may be curved along all of part of their length as shown by the dashed line M on the right side platform 32. Each supportive rotary unit 200 permits each respective side platform member 30 and/or 32 to pivot or swivel transversely with respect to the longitudinal axis of the connecting bridge 120, the pivotabilty being indicated by the arrows 201 and 202. This permits at least one side platform 30 or 32 of the platform arrangement 10 to be moved angularly into close non-orthogonal proximity towards and/or moved away and/or around and from any structure or building 90' or any non-rectilinear structure 91 being worked upon, such as for example, a tree, a pole or an aircraft tail. Such rotary support units 200 may be rotatively driven by properly empowered and also controlled by, for example, a pair of hydraulically, pneumatically or electrically powered, platform-controlled, worm gear arrangements 204, as represented in FIG. 11, the power supply not shown for clarity of drawings. Such power may for example, also be a manual crank 207 to turn the worm gear arrangement 204 for rotatively moving its respective side platform 30 and/or 32 on its rotary unit 200, as needed. Each rotary unit 200 may be comprised of a proper rotary support table and platform guiding track on the rotary support table for permitting both rotative and linear motion of the side platforms 30 and/or 32 with respect to the bridge 120.

It is to be further noted that the platform assembly 10 may be itself supported from one or more overhead cranes or derricks preferably at multiple connections on each crane or derrick 210 and 212, which platform assembly 10 is supportively connected to those (multiple) crane/derrick connections by a plurality of cables 206, partially represented in FIG. 11, which multiply supported cables 206 prevent the platform arrangement 10 from twisting or moving angularly with respect to any structure 90' or 91, being worked upon.

The invention thus comprises a support frame platform assembly generally of "H" shape in a plan view, independently slidably adjustable both "forwardly and rearwardly" and "widthwise" to a "U" shape or vice versa, for providing an adjustable platform for supporting workers and supplies about an elevated project such as for example, a chimney. The platform assembly has an elongated rectilinear floor panel "bridging" arrangement with an attached adjacent rear wall member supportively between a pair of adjustable sidewall and side floor panels at each end thereof. The sidewalls and side floor panels are adjustably movable independently forwardly and rearwardly with respect to the rear wall member. The rear wall member and its associated rectilinear floor panel arrangement are sideways adjustable in a telescoping or sliding manner with respect to the central portions of the rear wall and the elongated rectilinear floor panels, to permit the side walls and their associated floor panels to squeeze closer to a narrow chimney against which the platform assembly may be lifted. The platform itself is attached to the distal end of an articulable arm of a power lift truck for lifting of the platform up to and around an elevated chimney.

I claim:

1. An articulable, elevated-building-structure-adaptable platform assembly, adjustable between an "H" shape and a "U" shape, the platform assembly enabled to be attachable to a platform assembly lift arrangement, the platform assembly being enabled to be adjustably positioned adjacent an outer peripheral sides of an elevated building structure on at least three sides of the building structure, the platform assembly comprising:

a longitudinally extending anchor plate support frame bridging member defining a level, worker-usable, longitudinal, elongated, elevated-building-structure-abuttable deck, which said deck comprises a rear floor, the rear floor having a rear edge with an upstanding rear safety wall frame member fixedly attached along the rear edge thereof;

an abuttably adaptable right side platform and an abuttably adaptable left side platform, wherein each side platform is slidable transversely across the longitudinal elongated deck each of which is supported by the anchor plate support frame bridging member rear floor, to provide co-level adjustable side portions to the platform assembly, the left side platform and the right side platform each being independently movable co-planar with the anchor plate support frame bridging member, to effect a transition of the platform assembly from an "H" shape to a "U" shape and back again, and to be pivotable towards and away from one another level with the plane of the anchor plate support frame bridging member, so as to permit at least one side to be articulably adjacent at least one peripherally outermost side of an elevated building structure for lifting and supporting attending personnel and equipment about the building structure.

2. The articulable platform assembly as recited in claim 1, wherein the right side platform is transversely pivotable and movable independently with respect to the left side platform.

3. The articulable platform assembly as recited in claim 1, wherein the lift arrangement comprises an articulable crane.

4. The articulable platform assembly as recited in claim 3, wherein the crane has a plurality of cables under tension connected to the platform assembly to maintain stability of that platform assembly.

5. The articulable platform assembly as recited in claim 4, wherein the cables are connected to both ends of the side platforms.

6. The articulable platform assembly as recited in claim 1, wherein at least one side platform is attached to the bridging member by a rotary support unit therewith, to permit the pivoting movement of the side platform with respect to the bridging member

7. The articulable platform assembly as recited in claim 6, wherein the rotary support unit comprises a controlled worm gear arrangement.

8. The articulable platform assembly as recited in claim 1, wherein at least one of the side platforms is of curved configuration in its length.

9. A method of providing a manipulable worker support platform assembly to the peripheral portions of an elevated building structure, comprising the steps of:

attaching a platform assembly having a longitudinally extending anchor plate support frame bridging member defining a level, worker-usable, longitudinal, elongated, elevated-building-structure-abuttable deck, which deck comprises a rear floor, the rear floor having a rear edge with an upstanding rear safety wall frame member fixedly attached along the rear edge thereof, to an abuttably-adaptable right side platform and an abuttably-adaptable left side platform, wherein each side platform is slidable transversely across the longitudinal elongated deck each of which is supported by the anchor plate support frame bridging member rear floor, to provide co-level adjustable side portions to the platform assembly, the left side platform and the right side platform each being independently movable co-planar with the anchor plate support frame bridging member, to effect a transition of the platform assembly from an "H" shape to a "U" shape and back again, and to be pivotable towards and away from one another level with the plane of the anchor plate support frame bridging member; and attaching the anchor plate member of the platform assembly to an articulable lift device, wherein the platform assembly is manipulable so as to permit the anchor plate support frame bridging member and at least one side thereof to be articulably adjacent at least two peripherally outermost sides of an elevated building structure, the platform assembly enabled for the lifting and supporting of attending personnel and equipment about the elevated building structure.

10. The method as recited in claim 9, wherein the right side platform is transversely pivotable and movable independently with respect to the left side platform.

11. The method as recited in claim 9, wherein at least one of the side platforms is of curved configuration in its length.

* * * * *